US005904005A

United States Patent [19]

Dyer et al.

[11] Patent Number: 5,904,005

[45] Date of Patent: May 18, 1999

[54] MODULAR STRUCTURES

[75] Inventors: David Charles Dyer; Nicholas Anthony Lawler, both of Hertfordshire, United Kingdom

[73] Assignee: Kudos 2000 Limited, Hertfordshire, United Kingdom

[21] Appl. No.: 08/894,354

[22] PCT Filed: Feb. 15, 1996

[86] PCT No.: PCT/GB96/00321

§ 371 Date: Sep. 18, 1997

§ 102(e) Date: Sep. 18, 1997

[87] PCT Pub. No.: WO96/26329

PCT Pub. Date: Aug. 29, 1996

[30] Foreign Application Priority Data

Feb. 18, 1995 [GB] United Kingdom ..... 9503228

[51] Int. Cl.[6] ..... E04B 1/344

[52] U.S. Cl. ..... 52/71; 52/65; 52/79.5

[58] Field of Search ..... 52/79.5, 71, 65, 52/62, 69

[56] References Cited

U.S. PATENT DOCUMENTS

| | | | |
|---|---|---|---|
| 2,886,856 | 5/1959 | Che . | |
| 3,866,365 | 2/1975 | Honigman | 52/71 X |
| 4,633,626 | 1/1987 | Freeman et al. | 52/79.5 X |
| 4,726,158 | 2/1988 | Fagnoni | 52/79.5 |
| 4,741,133 | 5/1988 | Kutzner | 52/79.5 |

FOREIGN PATENT DOCUMENTS

| | | |
|---|---|---|
| 0144471 | 6/1985 | European Pat. Off. . |
| 654216 | 11/1937 | Germany . |
| 2620689 | 10/1977 | Germany . |
| 2172915 | 10/1986 | United Kingdom . |
| 8605829 | 10/1986 | WIPO . |

*Primary Examiner*—Robert Canfield
*Attorney, Agent, or Firm*—Young & Thompson

[57] ABSTRACT

A modular unit (10) for a building comprises a central frame (12) and four walls (14) arranged in opposing pairs on each side of the central frame (12) to give an I-shaped configuration. At least one of the pairs of opposing walls (14) is foldable towards the central frame (12) to make a unit of [-shaped or]-shaped configuration. The units (10) can be connected in series to make an extended building. The modular unit (10) is fitted with flooring (16) and a roof (22). Seals are provided between the central frame (12) and the walls (14), and between adjoining walls (14) in a multi-unit structure.

21 Claims, 16 Drawing Sheets

FIG. 30
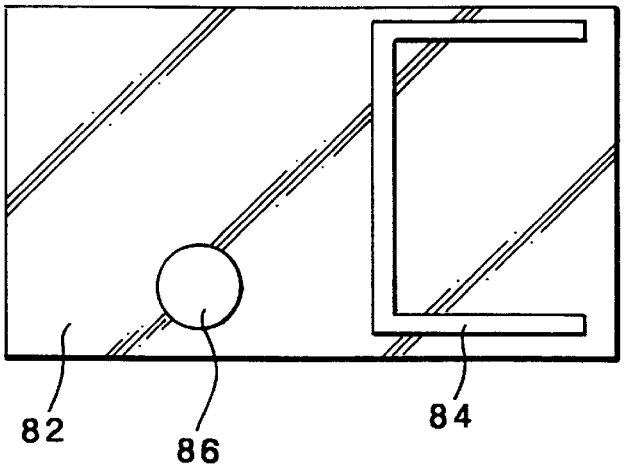
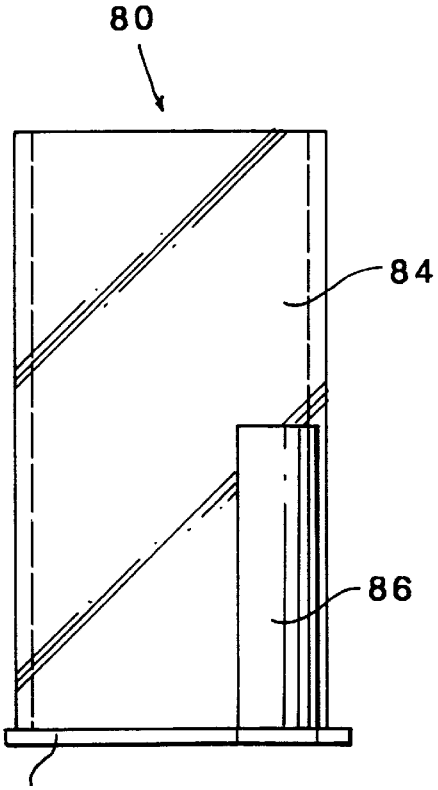
FIG. 31
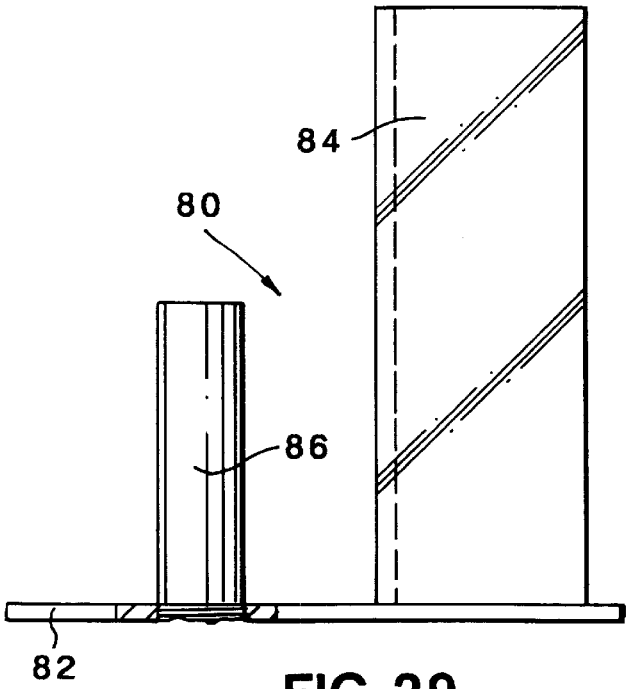
FIG. 29

MODULAR STRUCTURES

This invention relates to modular structure, particularly to modular buildings. The invention is particularly concerned with modular buildings comprising walls, floor and roof, with the walls being based upon a foldable frame structure.

In DE-A-2620689 there is described a transportable building which consists of a three-dimensional central cabin to which are connected pivotable wall and roof sections. When these are folded up to the central cabin one has a unit which resembles a container for transportation.

In GB-A-2172915 there is described a foldable building structure, such as a shed or lean-to. The structure is collapsible and is intended to be mounted against a wall.

In the design of modular buildings it is important that they should be capable of being easily and quickly assembled, that the structures should be simple in order to aid assembly and dismantling, and that they should be versatile so that a variety of different building layouts can be constructed with as small a number as possible of basic components. It is also important that the components of the structure should be sealed to prevent the ingress of water.

It is one object of the present invention to provide a modular structure, especially for use as a building, in which these objects are achieved and where one basic modular unit can be used as a key component of a variety of different structures.

It is another object of the invention to provide a building module which can be transformed in minutes from a flat pack to an erected, rigid structure without the need for special tools, skilled labour or cranes. The structure can equally easily be dismantled to a flat pack for transportation, redeployment or storage.

In accordance with the invention there is provided a modular unit for a building, comprising a central body and four walls pivotable relative to the central body and arranged in pairs on each side of the central body, characterised in that the central body comprises linear structural members connected together to define an open-centered frame, and the walls and frame together give an I-shaped configuration with at least one pair of the opposing pairs of walls being foldable towards the frame to make a unit of configuration.

Preferably, both pairs of opposing walls are foldable towards the central frame so that the unit is substantially flat for transportation and/or storage.

In a preferred embodiment, the outer vertical edges of the walls are provided with connector means to enable wall-to-wall connections to be made with an adjacent modular unit or units.

The foldable nature of the modules means that substantial savings can be achieved in terms of transport and necessary personnel for deployment or retrieval, as compared with conventional temporary portable structures.

With conventional portable structures what you see is what you get. With the modular structures of the present invention they are easily adaptable to create additional space as needed. This can be achieved by the addition of extra modules and movement of internal partitions.

The modular units of the present invention can be "fitted out" through the opposing pairs of foldable walls, i.e. openable end panels. This is particularly advantageous where large items are concerned and where one would normally have to dismantle the item for access through doorways.

It is a further advantage of the invention that wall panels, for example if damaged, can readily be replaced and without the need to dismantle the whole structure.

The modular building units of the present invention find widespread application. They can be used inside buildings or outside, for office, light industrial, military and residential purposes. Examples include use as waiting rooms, canteens, dormitories, hospitals, stores, clinics, security posts and barracks.

Preferably, sealing means are provided between the component parts of the modular building structure, for example between frames and panels and between individual panels.

In order that the invention may be more fully understood, a number of embodiments of modular structures in accordance with the invention will now be described by way of example and with reference to the accompanying drawings. In the drawings:

FIG. 29 is a side view of a connector for joining the frame of FIG. 20 to the wall panel of FIG. 26;

FIG. 30 is a top plan view of the connector of FIG. 29; and

FIG. 31 is a front view of the connector of FIGS. 29 and 30.

Figure 1:
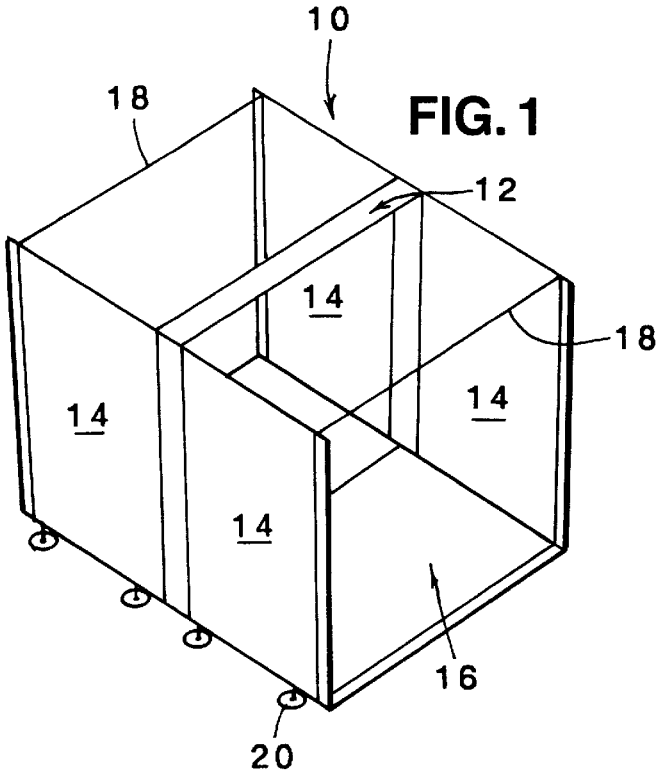
FIG. 1 is an isometric schematic diagram of a single module, fully open.
Figure 2:
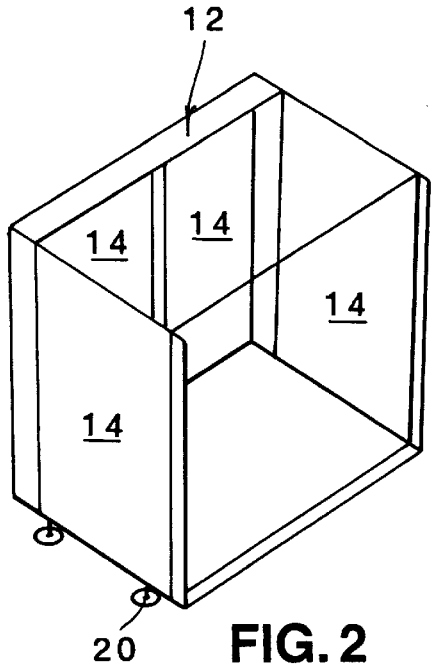
FIG. 2 is an isometric diagram of the module of FIG. 1, but with one end closed.
Figure 3:
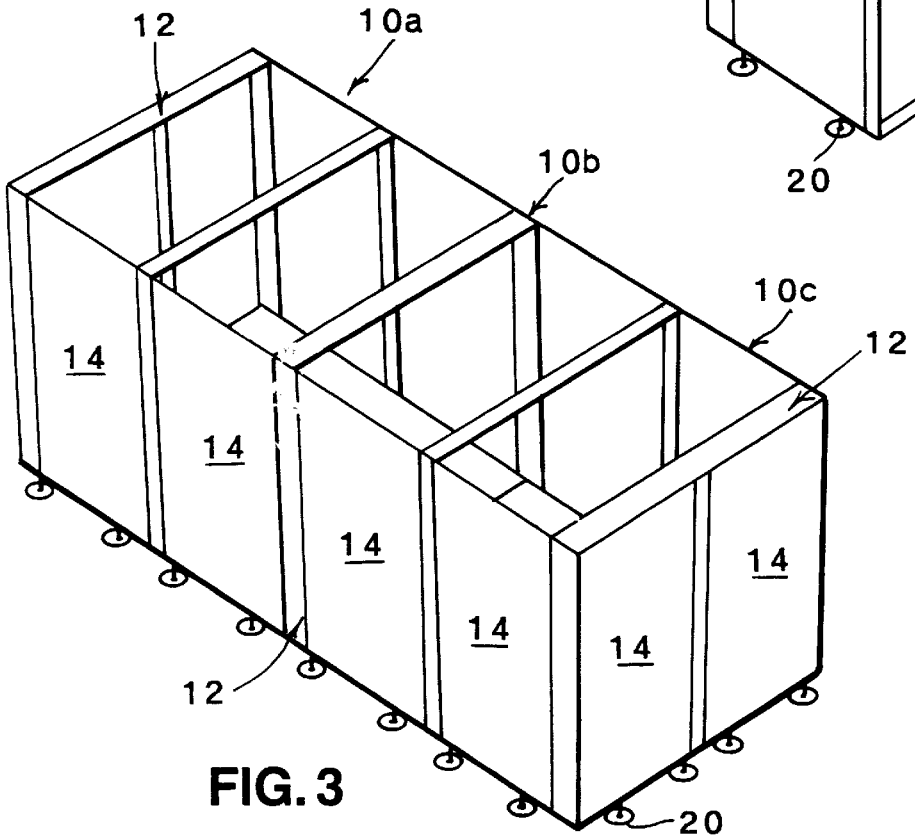
FIG. 3 is an isometric diagram of three of the modules shown in FIGS. 1 and 2, arranged as a room.

Reference is made first to FIGS. 1 to 3 to illustrate one aspect of the present invention. FIG. 1 shows a single module constructed in accordance with the present invention and indicated generally at 10. The module comprises a central, square or rectangular frame 12, four walls 14, and flooring 16. In practice, the module would also be provided with a roof, which is not shown in FIGS. 1 to 3 but will be described later. In FIG. 1 the four walls 14 are shown in an "open" state, thus providing what is in effect an open-ended tunnel. Bracing struts 18 are shown in FIG. 1 to maintain the position of the walls. The module thus has an I-shaped configuration in the open state.

Each of the walls 14 is hingedly mounted to the central frame 12, so as to be pivotable through 90° from the open position as shown in FIG. 1 to a "closed" position as indicated for two of the walls in FIG. 2. In FIG. 2, one of the bracing struts 18 has been removed and two of the walls 14 have been pivoted through 90° so as to form a closed end to the tunnel. In the case where two of the walls 14 are "closed", the module has an ]-shaped or [-shaped configuration. If all four walls 14 are folded closed, the module is ready for transportation or storage.

As shown in FIG. 3, one can arrange for example three modules 10*a*, 10*b*, 10*c* in line to form what is in effect a room or cabin. The central module 10*b* is in the fully open state, whereas each of the end modules 10*a*, 10*c* has two walls 14 folded into the closed position in order to provide ends to the room. The panel-to-panel connections which join the walls and the connections between the walls and the central frame 12 will be described hereinafter.

As will be seen in FIGS. 1 to 3, each of the walls is provided with adjustable feet 20. However, these are optional.

It will be appreciated that by virtue of the folding action of the walls 14, the module gives great versatility in terms of the way in which it can be linked with other modules to form modular structures of different sizes and configurations. The key to this is the fact that each of the four walls 14 which make up a module is pivotable through 90° between an open position and a closed position flush with the central frame 12.

Figure 4:
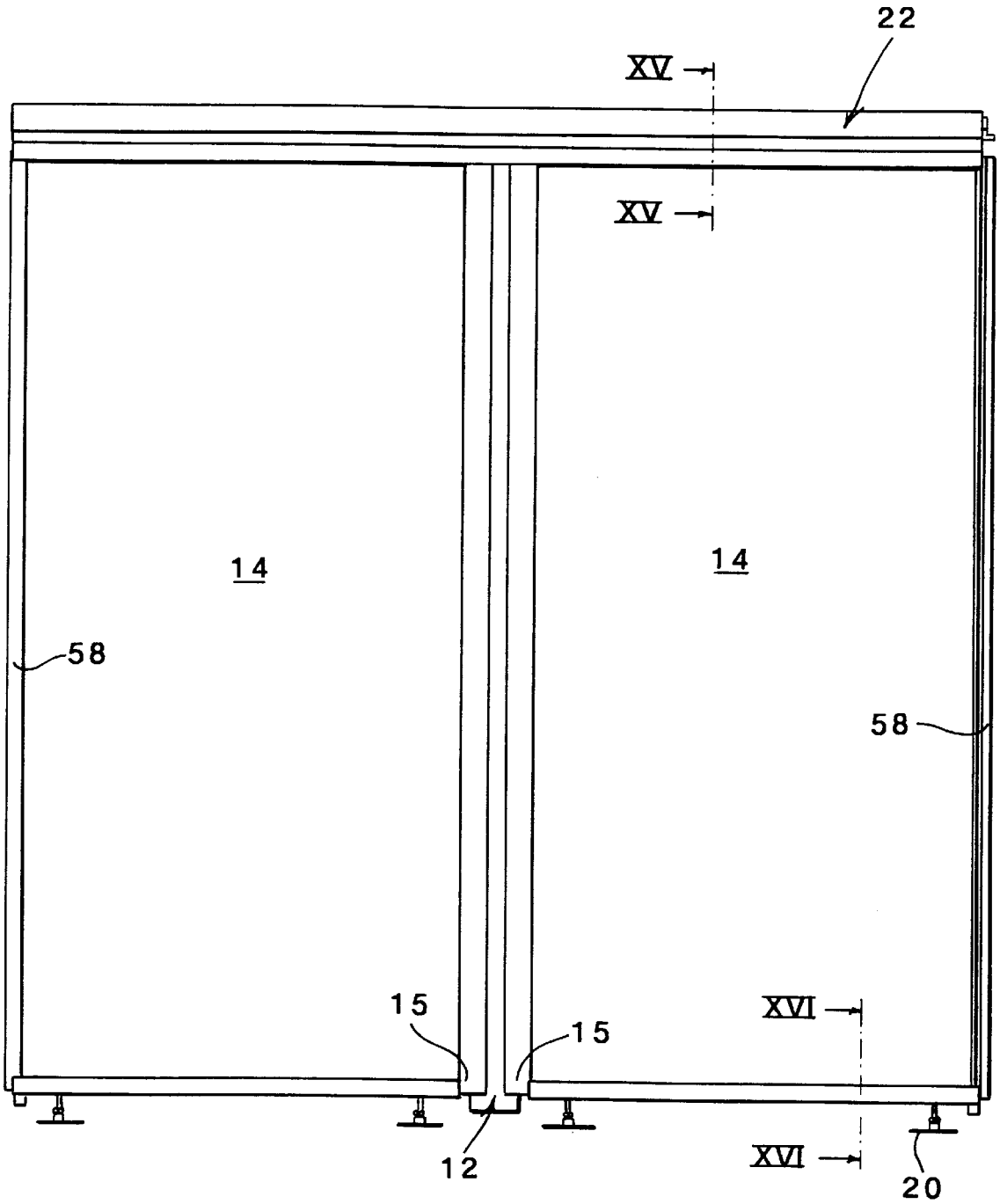
FIG. 4 is a front view of the single module shown in FIG. 1, with roof and on an enlarged scale.
Figure 5:
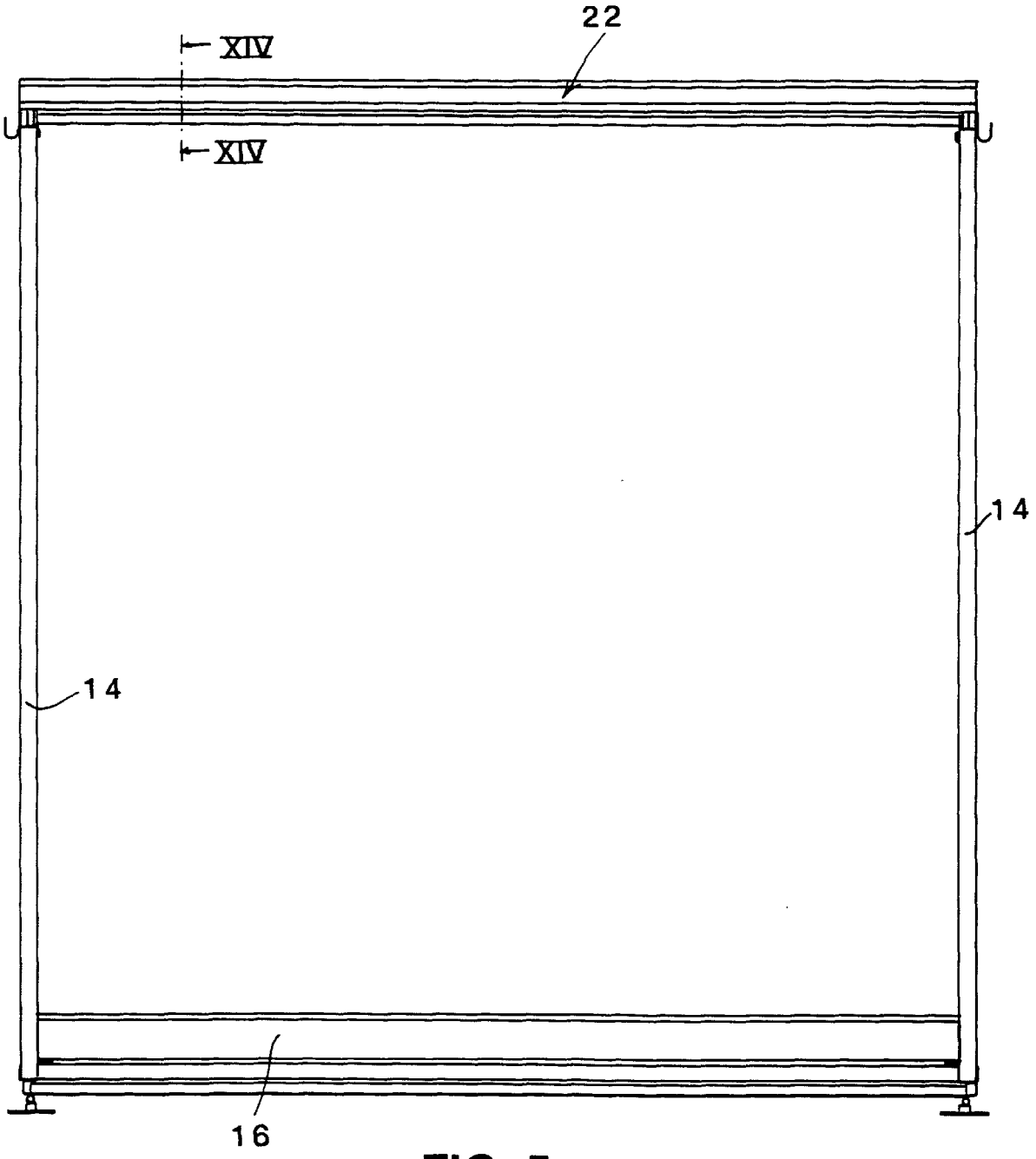
FIG. 5 is a side view of the single module as shown in FIG. 4.
Figure 6:
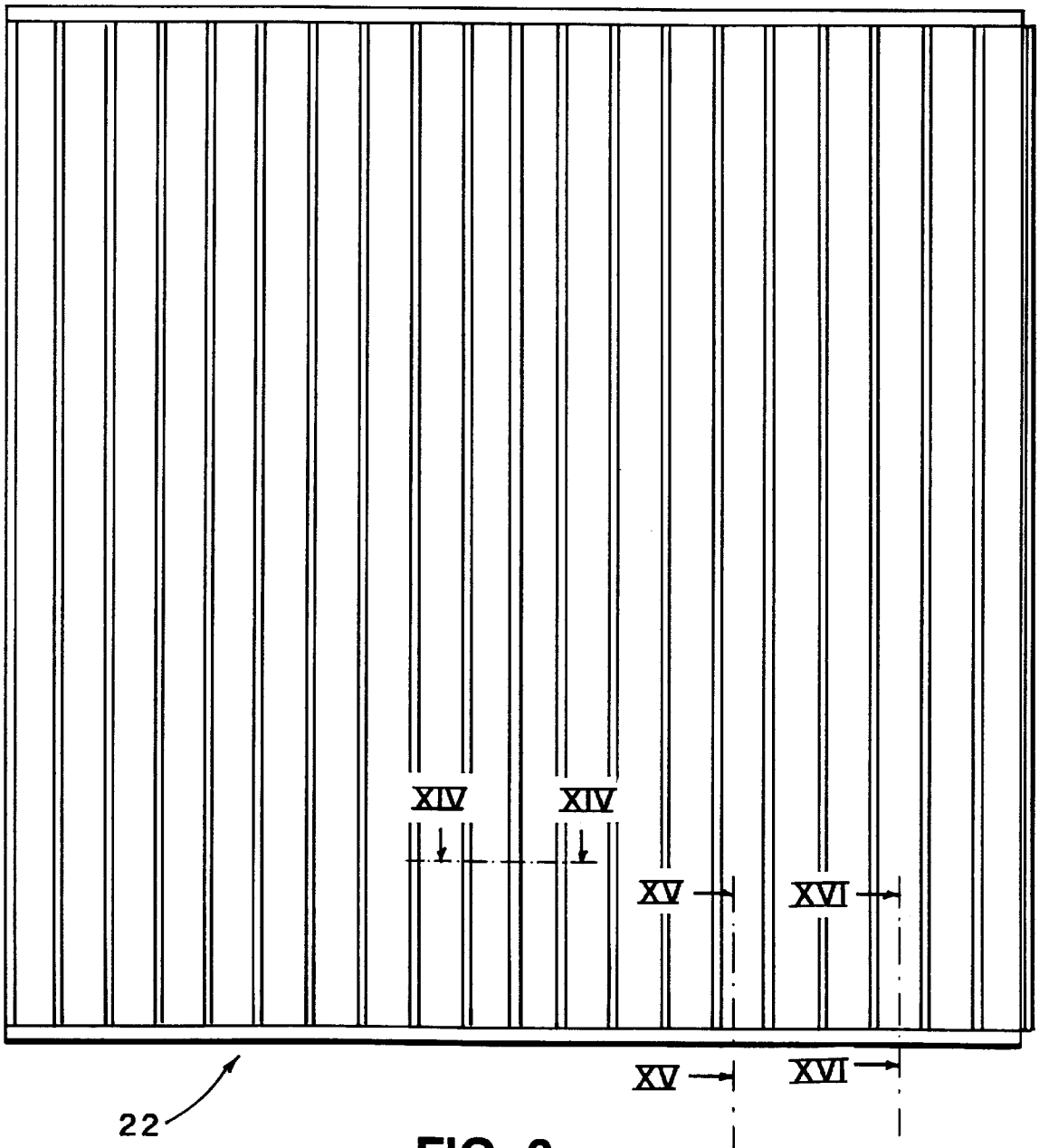
FIG. 6 is the top plan view of the module as shown in FIG. 4.
Figure 9:
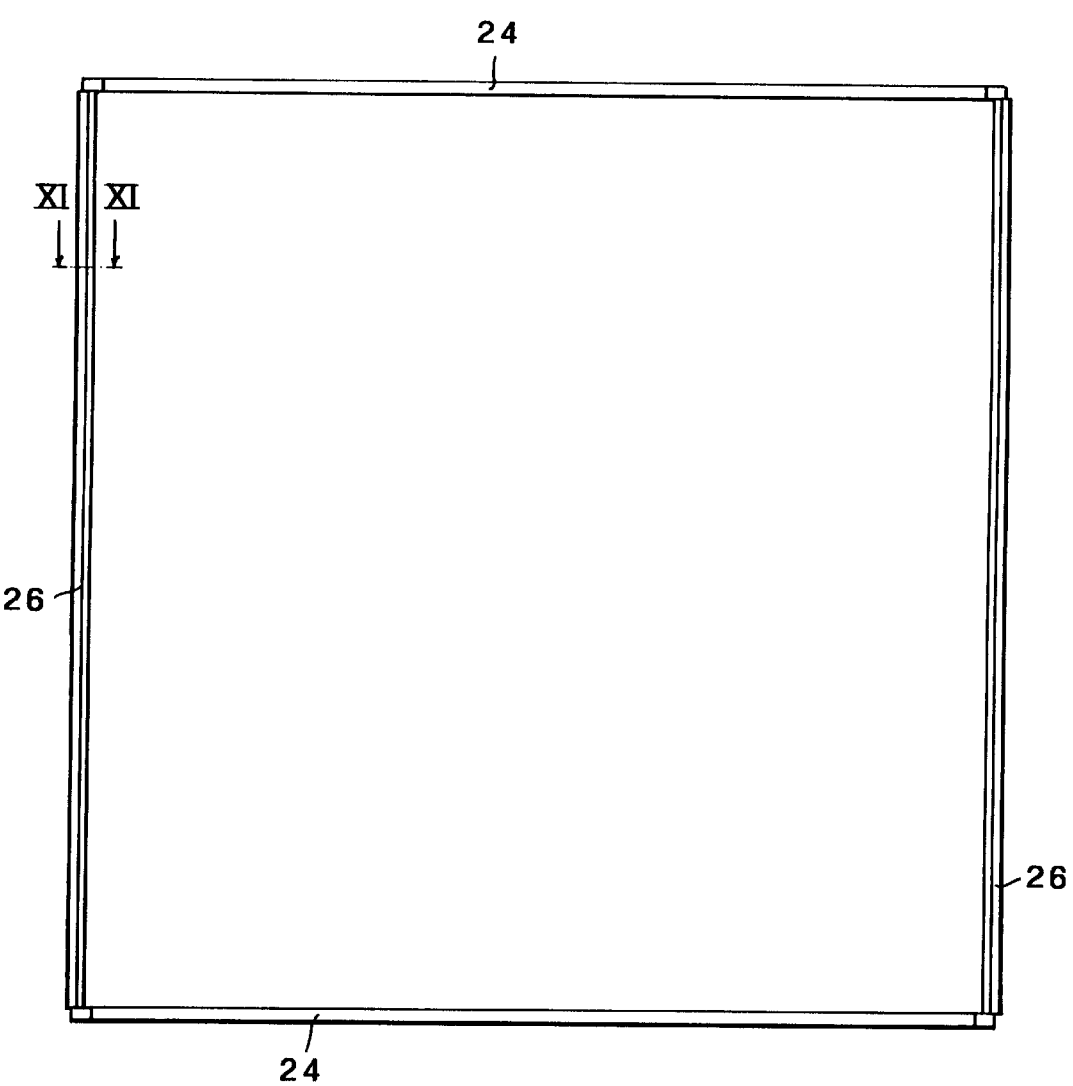
FIG. 9 is the side view of the central frame sub-assembly.
Figure 8:
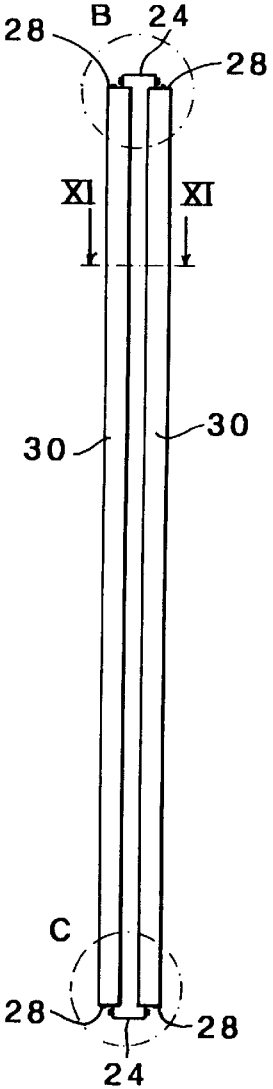
FIG. 8 is the front view of the central frame sub-assembly.
Figure 7:
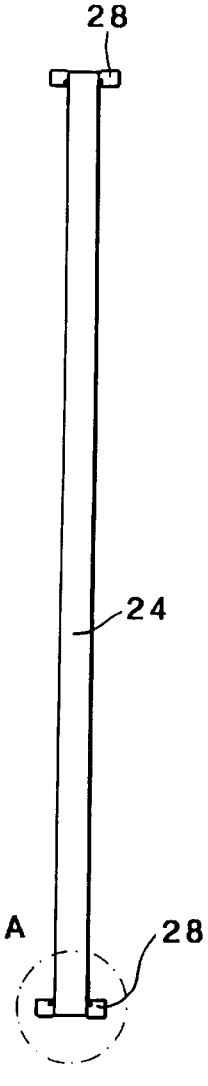
FIG. 7 is the top plan view of the central frame sub-assembly.
Figure 10:
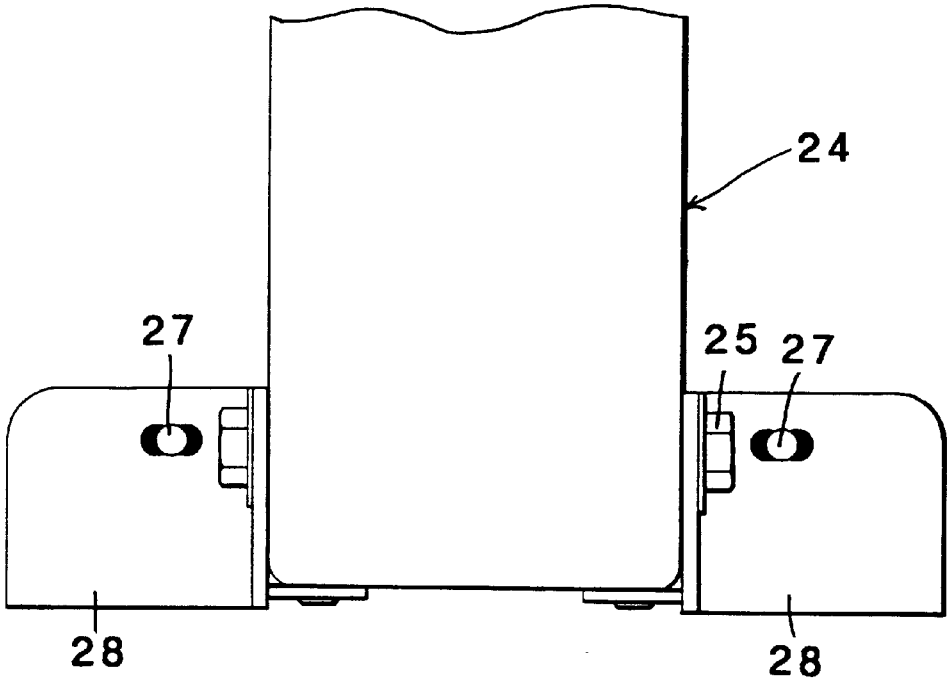
FIG. 10 is the detail A in FIG. 7, on an enlarged scale.

Reference is now made to FIGS. 4 to 6, which show further details of the modular structure. In these Figures of the drawings the roof of the structure is indicated generally at 22. This will be described in more detail hereinafter. Each pair of adjacent walls 14 is connected sealingly to the central frame 12. A flap seal 15 runs vertically down the wall, being anchored to the wall and engaging sealingly against the central frame 12, or an extension thereof, as shown more clearly in FIG. 18. Each wall 14 comprises a panel made from two skins of steel or aluminum, e.g. 0.5 mm thick, with a foam polymer core, e.g. 40 mm thick. Each vertical side of each panel 14 has affixed thereto, as by studs 60 (FIG. 18), an aluminum section 58 formed as an extrusion. It is to be noted that the wall 14 to the left of the central frame 12 has a handed vertical edge extrusion 58, as compared with the wall 14 to the right of the central frame which does not. The flooring 16 is indicated also in FIG. 5.

Figure 11:
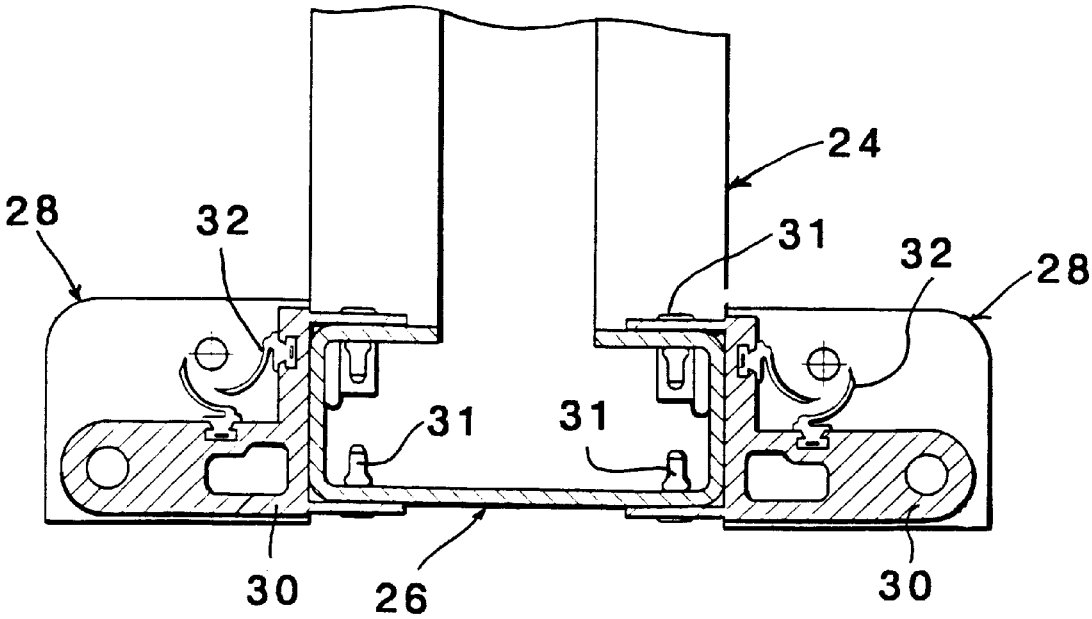
FIG. 11 is the sectional view XI—XI in FIGS. 8 and 9, on an enlarged scale.
Figure 12:
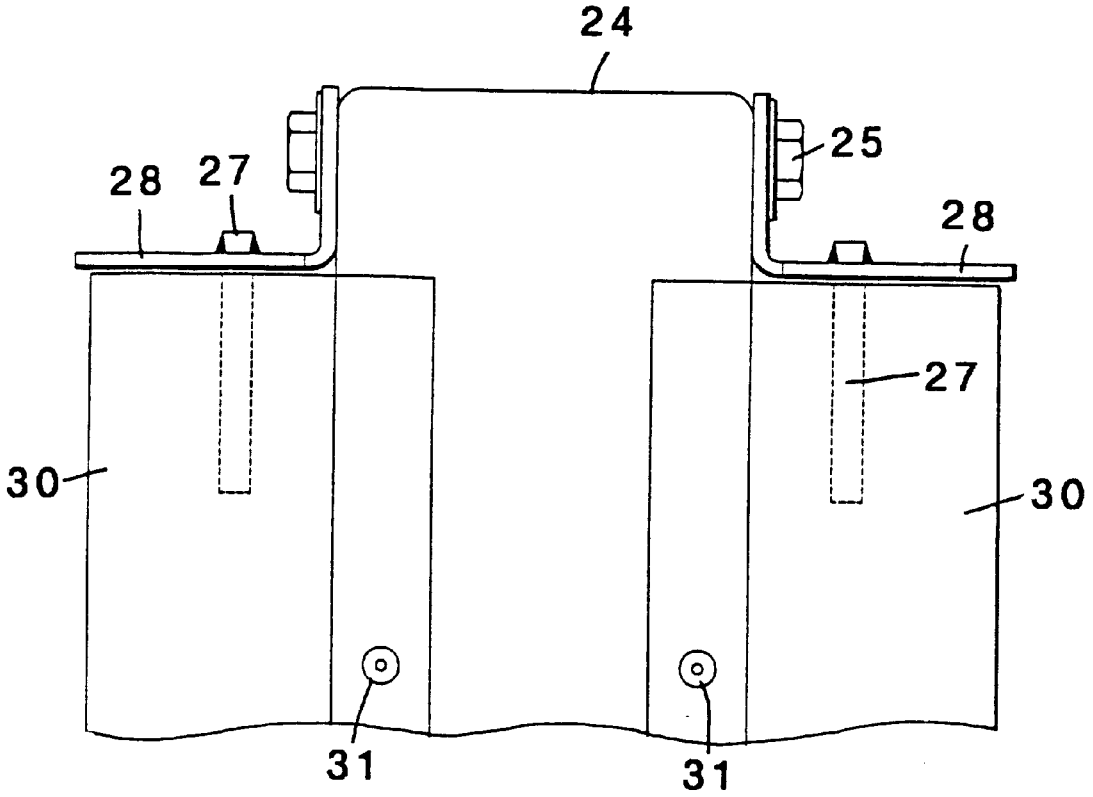
FIG. 12 is the detail B in FIG. 8, on an enlarged scale.
Figure 13:
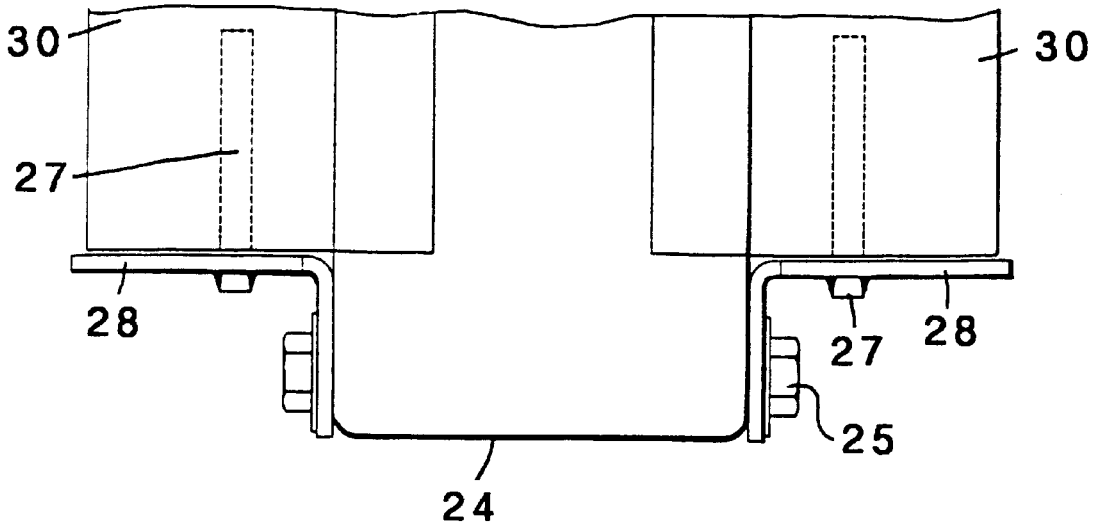
FIG. 13 is the detail C in FIG. 8, on an enlarged scale.
Figure 18:
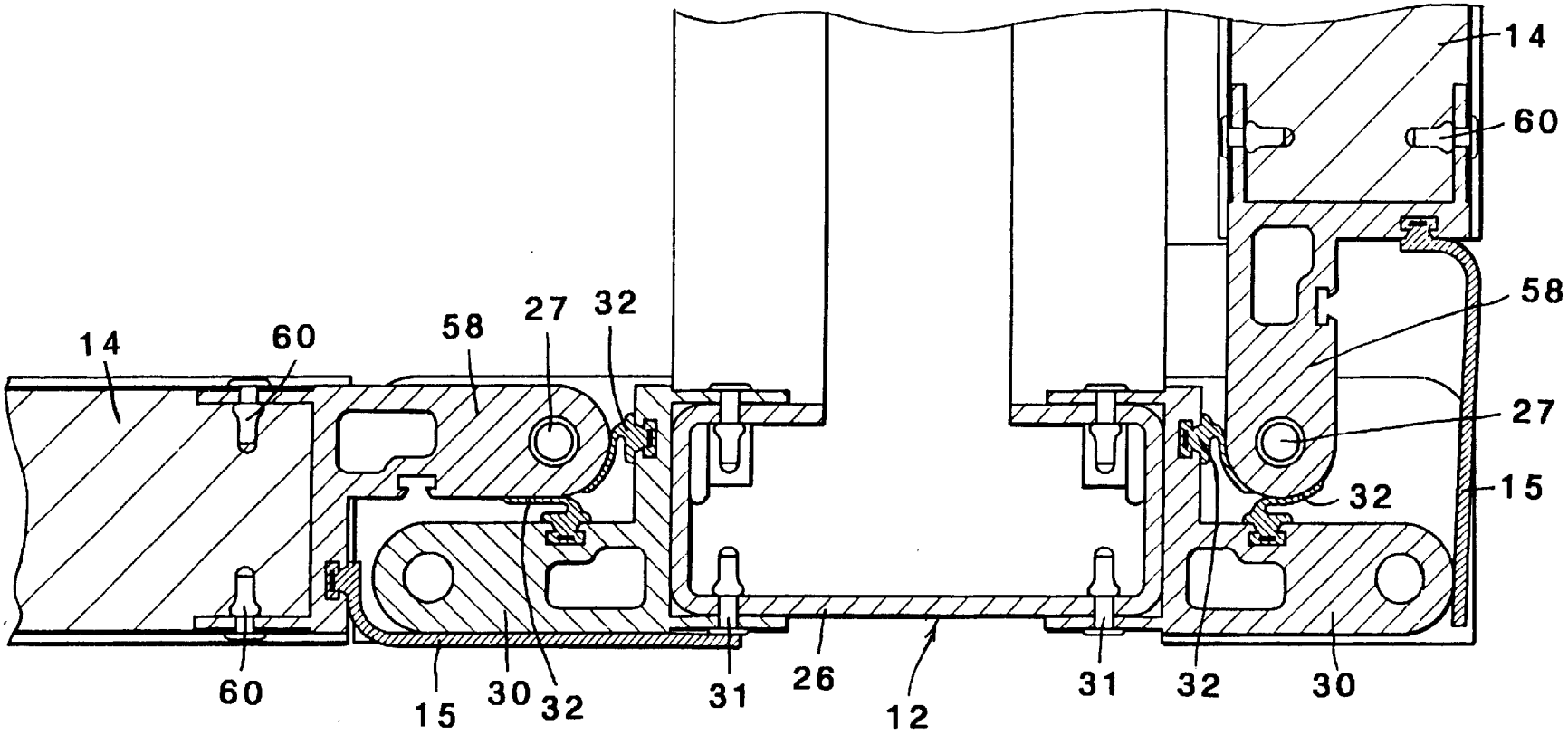
FIG. 18 is a sectional view corresponding to FIG. 17.

Reference is now made to FIGS. 7 to 13 which illustrate the construction of the central frame sub-assembly 12. The central frame sub-assembly 12 consists of two steel horizontal members 24, two steel vertical members 26, each being of tubular construction, slotted in one of the longer walls, i.e. the internally facing wall. This is shown most clearly in FIG. 11 for the vertical member 26. Steel hinge plates 28 at the top and bottom of the frame are used to connect the vertical and horizontal members. The hinge plates 28 are fixedly connected to the central frame by bolts 2S and the horizontal portion of each L-shaped hinge plate has a hinge pin 27 welded thereto to project upwards from the plates at the bottom of the frame and downwards from the plates at the top of the frame. As shown most clearly in FIG. 18, the hinge pins 27 seat in holes in the vertical extrusions 58 which run the height of the walls 14, so that the walls can be folded relative to the central frame. The sub-assembly 12 also includes two aluminum seal holders 30 for each vertical frame member 26. These seal holders 30 are connected to the frame members 26 by studs 31 and extend vertically co-extensive with the wall extrusions 58. Each seal holder 30 carries two lip seals 32 in the internal faces of the holder, as shown in FIGS. 11 and 18. The lip seals are of silicone rubber.

Figure 14:
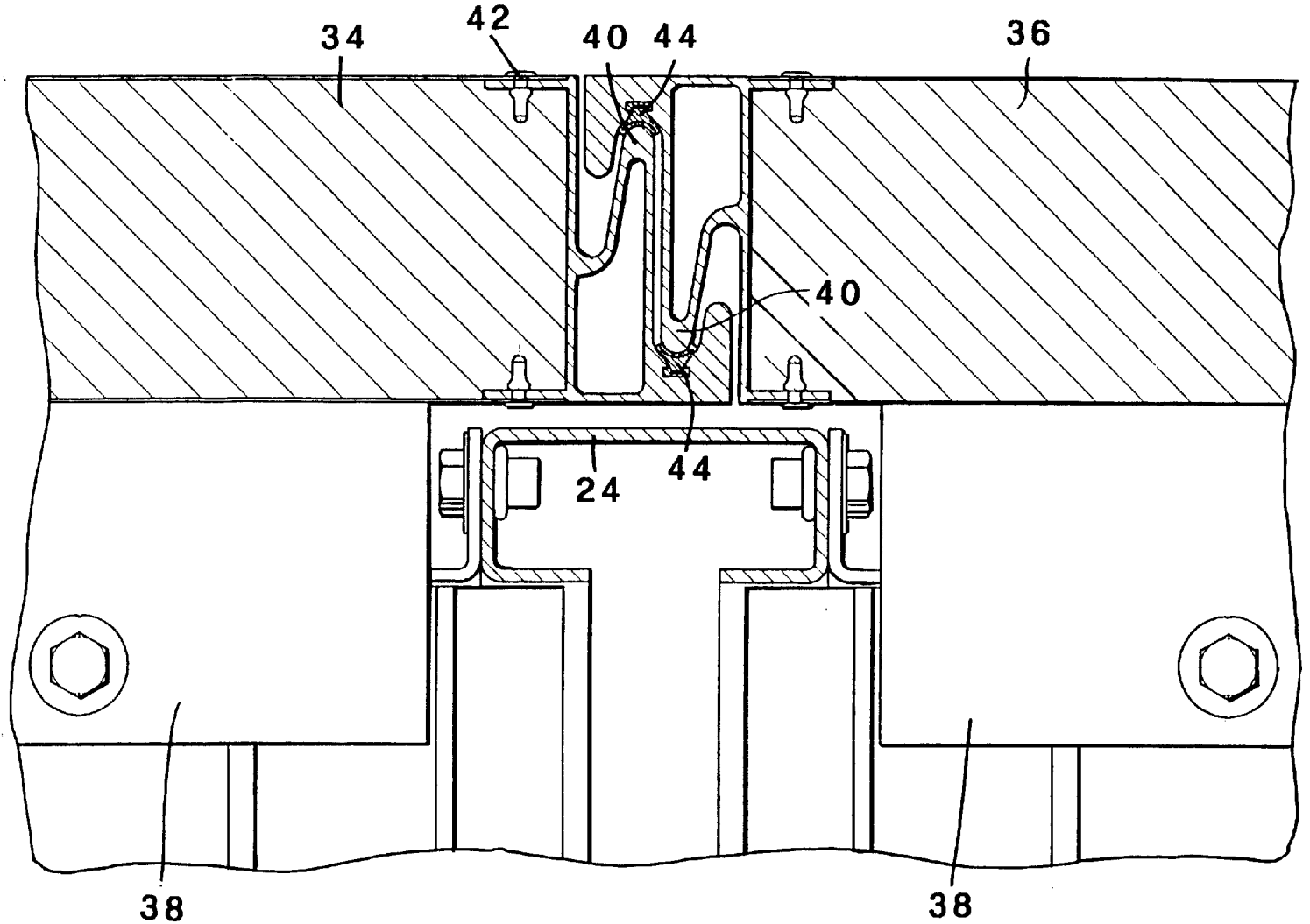
FIG. 14 is the sectional view taken along the lines XIV—XIV in FIGS. 5 and 6.

FIG. 14 shows the roof structure in more detail and in particular the way in which two roof sections are sealed at their junction. In FIG. 14 there is shown a junction between two roof sections 34, 36 above the central frame. Each roof section 34, 36 is of sandwich construction with polyurethane housed between two steel skins. A roof seating extrusion of aluminum is indicated at 38. The roof section 34 has an aluminum roof edge extrusion 40 along its junction edge, the extrusion being riveted to the roof section 34 by rivets 42. The adjoining roof section 36 has a complementary edge extrusion 40. Between the edge extrusions 40 there is provided a pair of silicone rubber compression seals 44 to prevent the ingress of water between the roof sections. The configuration of the roof edge extrusions 40 provides a labyrinth-type seal which provides an effective barrier to the passage of water.

Figure 15:
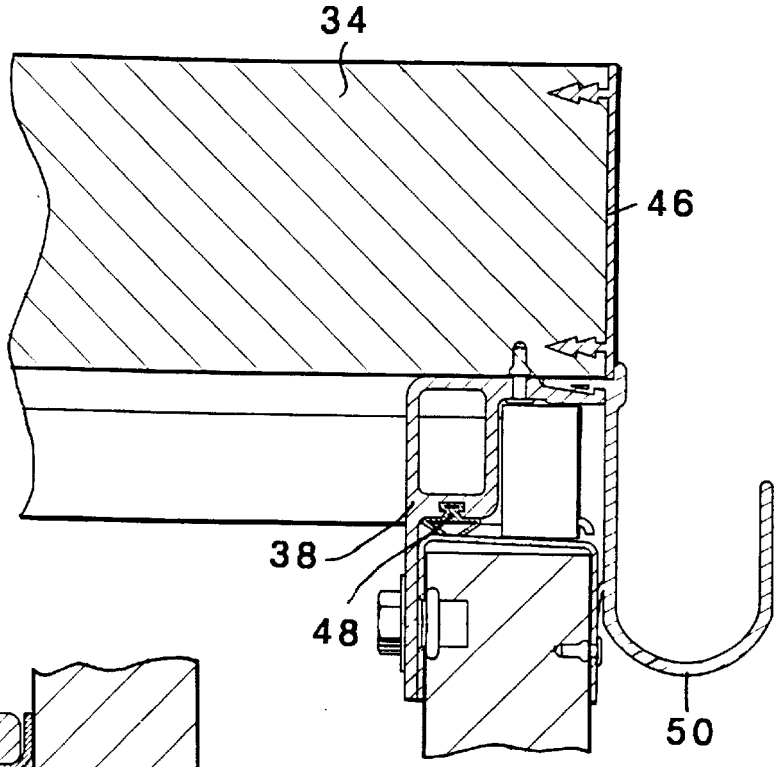
FIG. 15 is the sectional view taken along the lines XV—XV in FIGS. 4 and 6.

FIG. 15 shows the construction of the edge of a roof section 34. The edge of the roof panel is finished by an edge cover 46 of UPVC material. The roof seating extrusion 38 is shown below the panel. This carries a roof-to-wall compression seal 48 at its underside. The structure is also provided with guttering 50 on the external surface.

Figure 16:
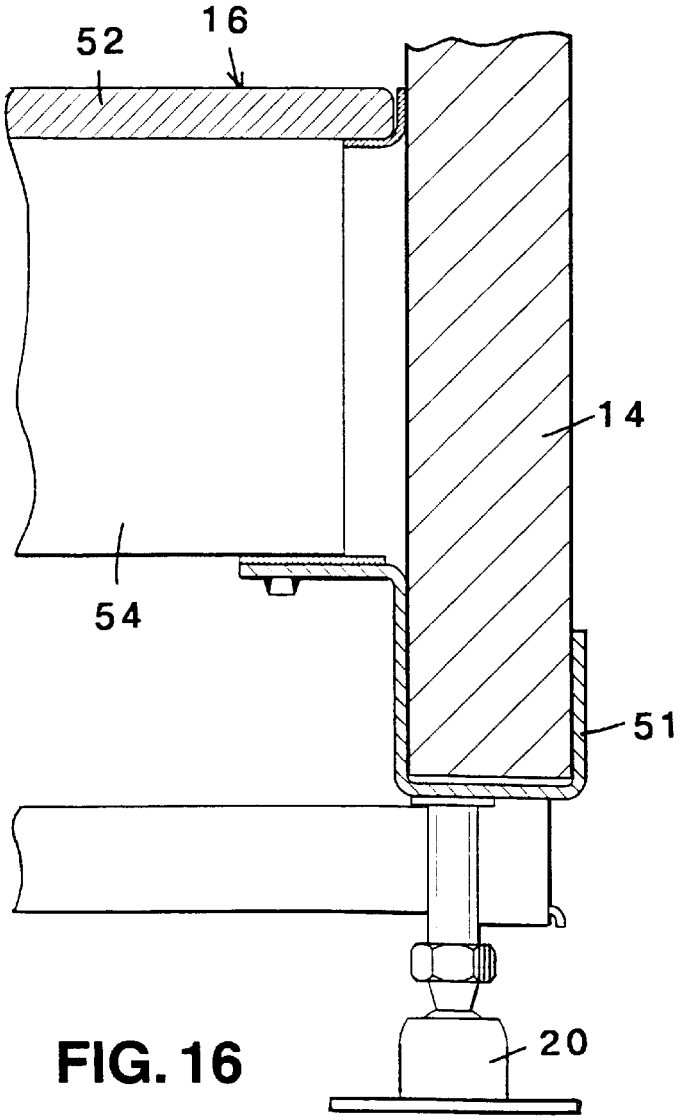
FIG. 16 is the sectional view taken along the lines XVI—XVI in FIGS. 4 and 6.

FIG. 16 shows more details of the structure of the module at the base of one of the walls 14, showing in particular the method of connecting the walls 14 to the flooring 16, i.e. by bolting a bracket 51 on the underside of the wall 14 to the underside of the flooring 16. The flooring may be made of plywood 52 over galvanised steel decking 54.

Figure 17:
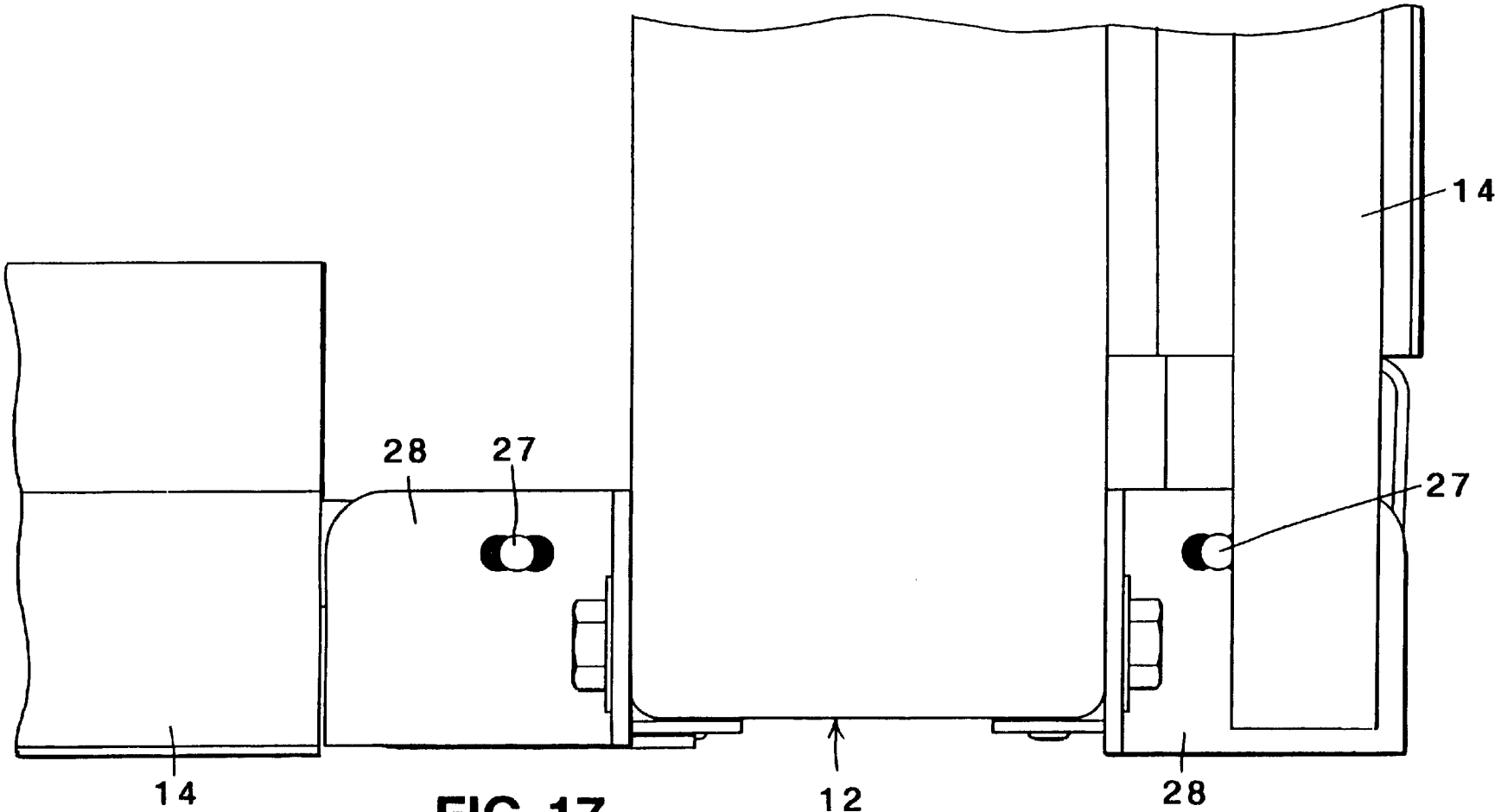
FIG. 17 is a detail view, on an enlarged scale, showing the folding of one wall relative to the central frame, viewed from above.

FIGS. 17 and 18 illustrate how the walls 14 are pivotable through 90° relative to the central frame 12. This is accomplished by means of the hinge plates 28, and the hinge pins 27. The edge of each wall 14 adjacent to the central frame 12 is provided with its wall edge extrusion 58 which is complementary to the seal holders 30 which are riveted to the central frame 12 by the studs 31. The lip seals 32 which are carried by the seal holders 30 engage the wall edge extrusions 58 to provide a double vertical seal at each junction between a wall and the central frame. The sealing is made more secure by the provision of the flap seal 15 which is carried by the wall edge extrusion 58 and overlies the outside face of the seal holder 30 right up to the junction with the vertical member 26 of the central frame 12. As can be seen from the right-hand side of FIG. 18, when the wall 14 is pivoted into its folded closed position the flap seal 15 still performs a sealing function, in that it maintains contact with the rounded end of the seal holder 30 and thereby maintains the integrity of the outside surface of the structure. There is thus in all circumstances a total of three seals 15, 32, 32 between the outside and the inside of the structure, regardless of whether the walls 14 are in the open or closed positions. The two internal lip seals 32 can be seen to maintain their sealing contact with the wall edge extrusions 58 in all is positions of the walls.

Figure 19:
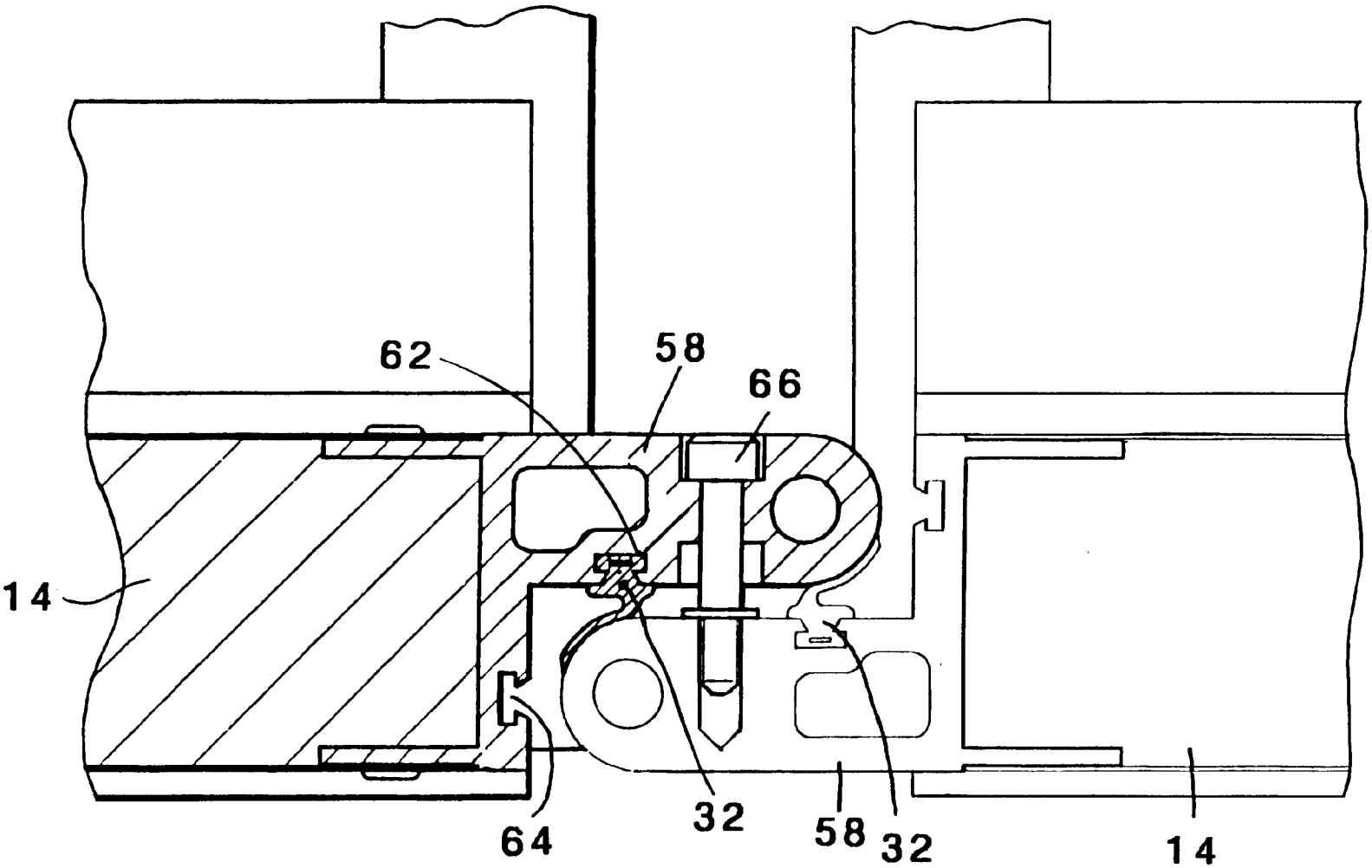
FIG. 19 is a part-sectional view, to illustrate the connection of two panels one to another.
Figure 21:
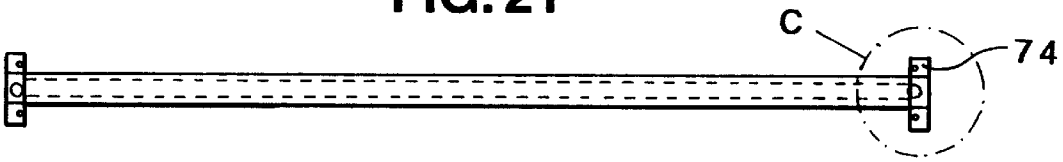
FIG. 21 is a top plan view of the frame of FIG. 20.
Figure 20:
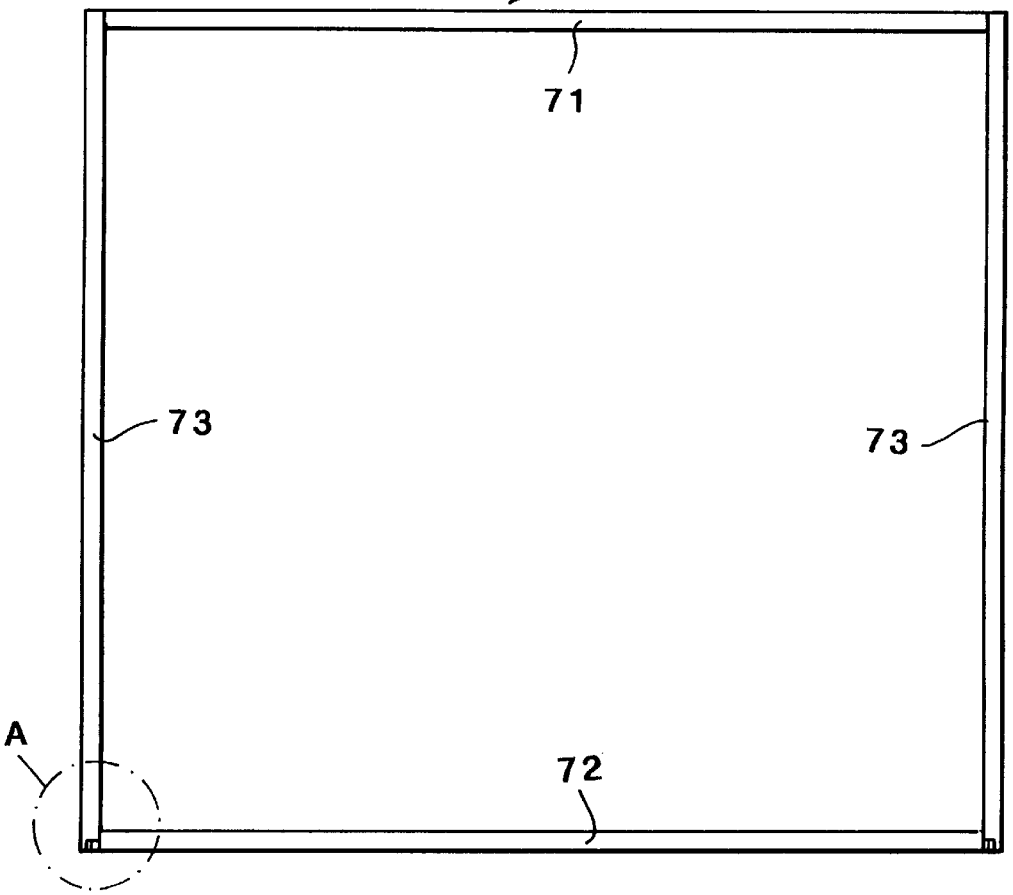
FIG. 20 is a side view of a second embodiment of central frame sub-assembly.
Figure 22:
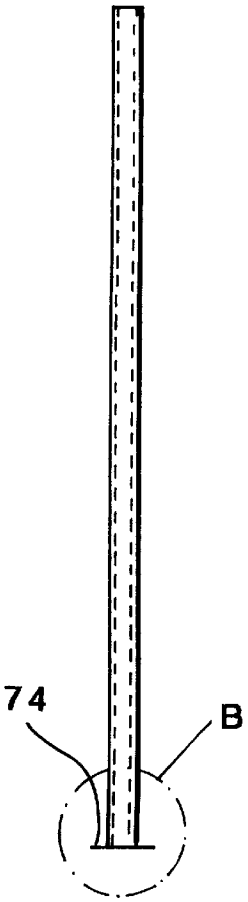
FIG. 22 is a front view of the frame of FIG. 20.
Figure 25:
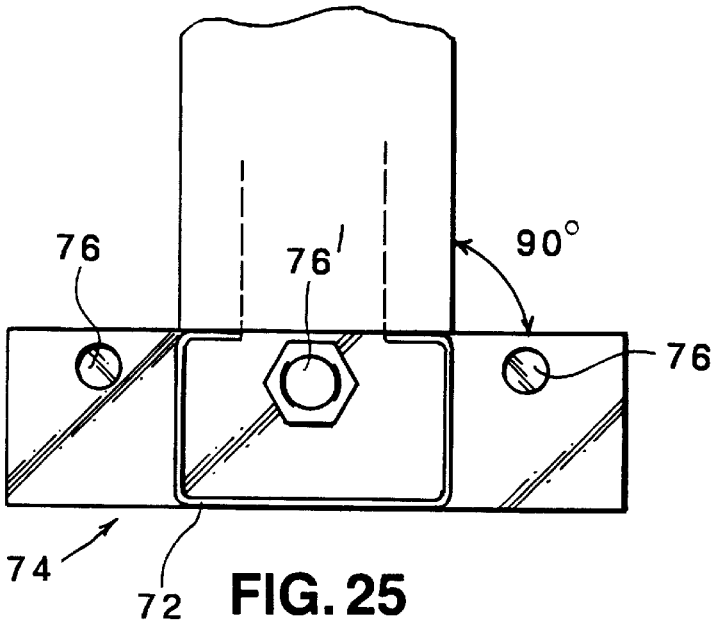
FIG. 25 is an enlarged view of the detail C of FIG. 21.
Figure 23:
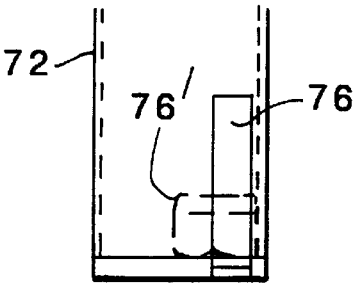
FIG. 23 is an enlarged view of the detail A of FIG. 20.
Figure 24:
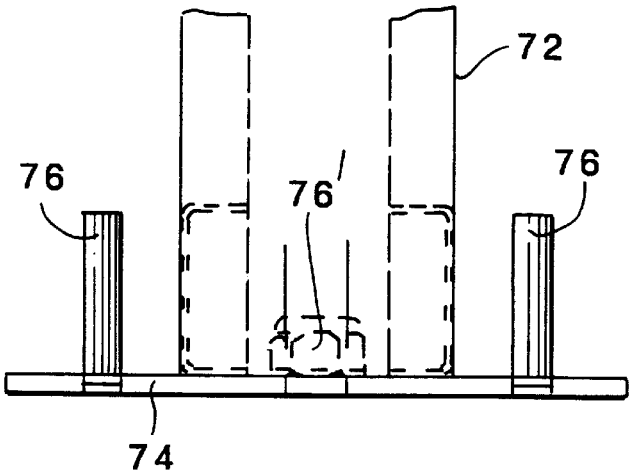
FIG. 24 is an enlarged view of the detail B of FIG. 22.

FIG. 19 illustrates the connection between a pair of adjoining walls 14. The walls are positioned for interconnection with their vertical edge extrusions 58 in overlapping relationship. Because of the L-shaped nature of the extrusions 58 the walls 14 are maintained in alignment. A bolt 66 is used to connect the overlapping extrusions 58, preferably from the inside, as shown. Alternatively, an over-centre toggle clip (not shown) can be used to hold the extrusions 58 together. This is much easier to use than bolts, without the risk of bolts being lost. Here, the wall edge extrusion 58 which has two slots, shown as 62 and 64, to carry lip seals, has a lip seal in only one of the slots, here slot 62, with the other slot 64 being left empty. This empty slot is the slot which would carry the flap seal 15 as shown in FIG. 18. With the provision of a lip seal 32 in slot 62, for each wall 14, one has a double seal between the outside and the inside of the structure.

Referring now to FIGS. 20 to 25 of the drawings, there is shown an alternative embodiment of central frame assembly. The central frame assembly is here indicated generally at 70. It comprises upper and lower horizontal members 71 and 72 respectively and two vertical members 73. In this embodiment, the top of each of the side members 73 is open. As in the first embodiment, each of the structural members 71, 72, 73 is hollow with a slot extending the length of each member and facing towards the interior of the assembly. At the bottom of each side member 73 there is secured a base plate 74 by means of a bolt and nut 76. The base plate 74 projects laterally from the bottom of the central frame and on each side of the side member 73 carries an upstanding pivot pin 76. The pivot pins 76 are fixedly mounted to the base plates 74.

Figure 28:
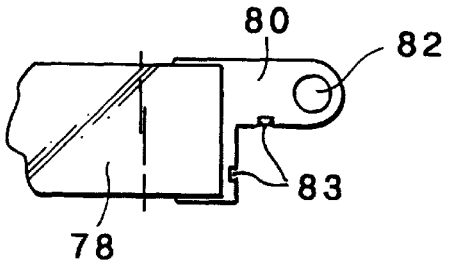
FIG. 28 is an enlarged view of one end of the wall panel shown in FIG. 27.
Figure 27:
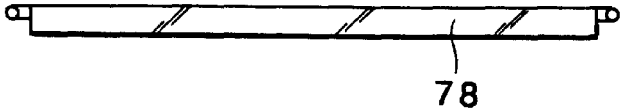
FIG. 27 is a top plan view of the wall panel of FIG. 26.
Figure 26:
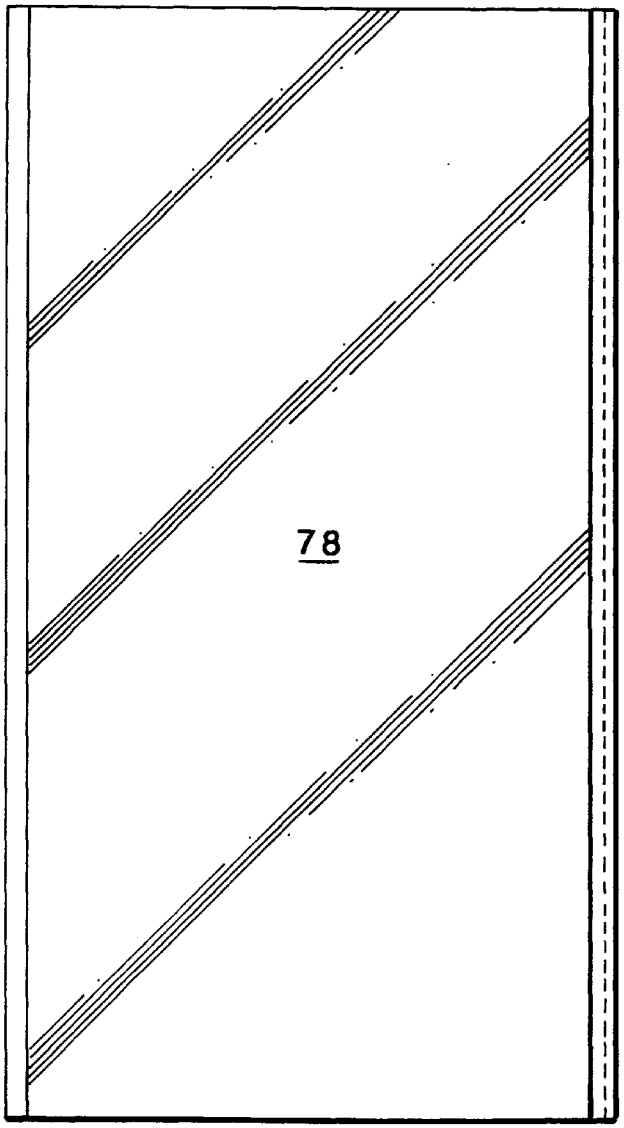
FIG. 26 is a front view of a wall panel for use with the frame of FIGS. 20 to 25.

FIGS. 26 to 28 show details of a wall panel 78 adapted to be fitted to the central frame 70 to provide a structure similar to that shown in the first embodiment. In this embodiment, each vertical side of the wall panel 78 is fitted with an elongate extrusion 80. The extrusion 80 is L-shaped in section and has a vertical hole 82 extending down the length of the extrusion. This hole 82 is positioned so that it will receive one of the pivot pins 76 of the base plate 74 when the wall panel 78 is offered up to the central frame 70 on assembly. As in the first embodiment, the extrusion 80 is provided with vertically extending slots 83 to receive lip seals for engagement with a facing portion of the central frame.

As mentioned above, the top of each side member 72 of the central frame 70 is open. The connector indicated generally at 80 in FIGS. 29 to 31 is used to link the wall panels 78 to the central frame 70 in a simple way which avoids the need for bolting parts together as in the first embodiment. The connector 80 comprises a flat plate 82 which has a U-shaped portion 84 adjacent to one end. The plate 82 also is provided with a projecting pin 86 which is welded for example to the plate 82. The pin 86 extends parallel to the U-shaped portion 84.

In the assembly of a wall panel 78 to the central frame 70, the wall panel 78 has the hole 82 in its edge extrusion 80 set down onto the upwardly projecting pin 76. The wall panel is then held in alignment with the central frame 70, with the adjacent edges parallel to one another, and the connector 80 is then pushed down from above to link the two parts and bridge the gap between them. The U-shaped portion 84 of the connector fits down into the open upper end of the side member 73 of the central frame and the projecting pin 86 of the connector is received in the hole 82 in the edge extrusion 80 of the wall panel. By this simple push fit, which may be signified by a "click", the central frame and the wall panel are sufficiently connected one to the other for the rest of the assembly to continue. Because of the absence of any bolts or other relatively complex connecting means between the two parts, not only is assembly made easier but it is also readily possible to remove a wall panel for replacement if it should become damaged for example. To remove a wall panel it is simply necessary to pull out the connector 80 and to lift the panel from the seating pins 76 at the base.

In each of the embodiments, because the structural members which make up the central frame are hollow, advantage is taken of this to install all the necessary electrical systems and wiring within the central frame structure. This can be seen most clearly from FIG. 11 where the hollow space within the vertical member 26 can receive electrical wiring, etc. In a practical system, with an extended length of cabin, it is necessary to repeat the provision of electrical wiring every six meters or so, by installing the wiring in the appropriate central frames. Each module is also earthed for safety requirements.

Yet a further advantage of the configuration of the structural members which make up the central frame is that partitioning can be positioned within the frame, seated in the slotted structural members. This also helps with improving the rigidity of the structure. The partitioning can be slidable.

Although the drawings show modules on just a single level, i.e. floor level, the design of the modules lends itself to a stacking system. It is possible for example to install flooring at the ceiling level of a module and to assemble a second module above the first. This again illustrates the versatility of the design of the module according to the invention.

We claim:

1. A modular unit for a building, comprising a central body (12) and four walls (14) pivotable relative to the central body and arranged in pairs on each side of the central body (12), wherein the central body (12) comprises linear structural members (24, 26) connected together to define an open-centered central frame, and the walls and frame together give an I-shaped configuration when in a fully open state and are arranged and constructed to fold to form a C-shaped configuration with at least one pair of the opposing pairs of walls being foldable towards the frame to make a unit of "]"-shaped or "["-shaped configuration, and wherein each of said walls (14) is connected to the central frame (12) at the top of the wall by a push-fit connector (80) which bridges the wall and frame.

2. A modular unit as claimed in claim 1, wherein both pairs of opposing walls (14) are foldable towards the central frame (12) so that the unit is substantially flat for transportation and/or storage when the walls are folded.

3. A modular unit as claimed in claim 1, wherein outer vertical edges of the walls (14) are provided with connector means (58) to enable wall-to-wall connections to be made with an adjacent modular unit or units.

4. A modular unit as claimed in claim 3, in which outer vertical edges of the walls (14) are provided with shaped sections (58) which are adapted to mutually overlap with adjacent walls.

5. A modular unit as claimed in claim 4, in which the shaped sections (58) are generally L-shaped.

6. A modular unit as claimed in claim 1, in which the push-fit connector (80) comprises a plate having a downwardly projecting portion (84) to be received in a member of the central frame and a downwardly projecting pin (86) to be received in a hole in the wall and acting as a pivot pin for the wall.

7. A modular unit as claimed in claim 6, in which the wall is seated at its base on a pivot pin (76) upstanding from a plate (74) secured at the bottom of the central frame.

8. A modular unit as claimed in claim 1, which includes first sealing means between the central frame (12) and each of said walls (14).

9. A modular unit as claimed in claim 8, in which said first sealing means comprises three seals (15, 32, 32) between the outside of the frame and the inside of the walls, both when the walls are opened and when the walls are folded closed.

10. A modular unit as claimed in claim 1, which includes second sealing means between adjoining ones of the walls, said second sealing means comprising a double seal between the outside and the inside of the walls.

11. A modular unit as claimed in claim 1, in which two of the seals (32) are within the contour of the walls and frame and the third seal is a flap seal (15) bridging an external gap between the frame and wall.

12. A modular unit as claimed in claim 11, wherein outer vertical edges of the walls (14) are provided with connector means (58) to enable wall-to-wall connections to be made with an adjacent modular unit or units.

13. A modular unit as claimed in claim 12, in which outer vertical edges of the walls (14) are provided with shaped sections (58) which are adapted to mutually overlap with adjacent walls.

14. A modular unit as claimed in claim 13, in which the shaped sections (58) are generally L-shaped.

15. A modular unit for a building, comprising:

a central body (12) and four walls (14) pivotable relative to the central body and arranged in pairs on each side of the central body (12), wherein the central body (12) comprises linear structural members (24, 26) connected together to define an open-centered central frame, and the walls and frame together give an I-shaped configuration when in a fully open state and are arranged and constructed to fold to form a C-shaped configuration with at least one pair of the opposing pairs of walls being foldable towards the frame to make a unit of "]"-shaped or "["-shaped configuration; and first sealing means between the central frame (12) and each of said walls (14).

16. A modular unit as claimed in claim 15, which includes second sealing means between adjoining ones of the walls, said second sealing means comprising a double seal between the outside and the inside of the walls.

17. A modular unit as claimed in claim 16, wherein each of said walls (14) is connected to the central frame (12) at the top of the wall by a push-fit connector (80) which bridges the wall and frame.

18. A modular unit as claimed in claim 15, wherein outer vertical edges of the walls (14) are provided with connector means (58) to enable wall-to-wall connections to be made with an adjacent modular unit or units, and wherein said outer vertical edges of the walls (14) are provided with shaped sections (58) which are adapted to mutually overlap with adjacent walls.

19. A modular unit for a building, comprising:

a central body (12) and four walls (14) pivotable relative to the central body and arranged in pairs on each side of the central body (12);

wherein the central body (12) comprises linear structural members (24, 26) connected together to define an open-centered central frame, and the walls and frame together give an I-shaped configuration when in a fully open state and are arranged and constructed to fold to form a C-shaped configuration with at least one pair of the opposing pairs of walls being foldable towards the frame to make a unit of "]"-shaped or "["-shaped configuration; and sealing means between adjoining ones of the walls, said sealing means comprising a double seal between the outside and the inside of the walls.

20. A modular unit as claimed in claim 19, wherein outer vertical edges of the walls (14) are provided with connector means (58) to enable wall-to-wall connections to be made with an adjacent modular unit or units, and wherein said outer vertical edges of the walls (14) are provided with shaped sections (58) which are adapted to mutually overlap with adjacent walls.

21. A modular building unit, comprising:

a central open-centered frame with two opposing side members connected by two base members; and four closed walls, two of said walls being pivotally attached to one of said side members and two of said walls being pivotally attached to the other one of said side members so that said four walls fold onto said frame to put the building unit in a flat form when all said four walls are completely folded, so that said four walls unfold away from said frame to put the building unit in a form of a linear passageway with each pair of said walls forming a different side of the passageway having one of said side members at a middle thereof when said four walls are unfolded about 90°, and so that one end of the linear passageway is closed when two of said walls are unfolded about 90° and two of said walls are completely folded.

* * * * *